United States Patent [19]

Op De Beeck et al.

[11] Patent Number: 4,527,083

[45] Date of Patent: Jul. 2, 1985

[54] GAS AND/OR VAPOR DISCHARGE LAMP PROVIDED WITH A U-SHAPED DISCHARGE TUBE

[75] Inventors: Herbert K. M. Op De Beeck; Joannes M. T. Peeters, both of Eindhoven, Netherlands; Peter K. R. M. Steeman, Turnhout, Belgium

[73] Assignee: U.S. Philips Corporation, New York, N.Y.

[21] Appl. No.: 425,215

[22] Filed: Sep. 28, 1982

[30] Foreign Application Priority Data

Oct. 8, 1981 [NL] Netherlands ..... 8104587

[51] Int. Cl.[3] ..... H01J 61/34; H01J 61/74

[52] U.S. Cl. ..... 313/25; 313/573

[58] Field of Search ..... 313/25, 634, 573

[56] References Cited

U.S. PATENT DOCUMENTS 4,129,800 12/1978 Van Benthem et al. ..... 313/25

FOREIGN PATENT DOCUMENTS 815782 7/1959 United Kingdom ..... 313/25

*Primary Examiner*—Palmer Demeo
*Assistant Examiner*—Sandra L. O'Shea
*Attorney, Agent, or Firm*—Robert S. Smith

[57] ABSTRACT

A discharge lamp provided with a U-shaped discharge tube and an outer envelope surrounding this tube. The bend of the discharge tube is supported with respect to the outer envelope by means of a metal member of sheet material. A few strips of this member engage the bend of the discharge tube. The metal member is composed of two parts twisted together which provide together a substantially light-tight transverse separation between the outer envelope and the discharge tube. The metal member maintains the bend of the operating lamp being kept at a relatively high temperature to improve luminous efficacy.

6 Claims, 7 Drawing Figures

GAS AND/OR VAPOR DISCHARGE LAMP PROVIDED WITH A U-SHAPED DISCHARGE TUBE

The invention relates to a gas and/or vapor discharge lamp provided with a U-shaped discharge tube and an elongate outer envelope surrounding this tube. A bend of this discharge tube interconnects the two limbs of the discharge tube. The tube is supported with respect to the outer envelope by means of a metal member of sheet material. The metal member has a flat annular part which is arranged mainly transverse to the longitudinal direction of the outer envelope and is provided with strips bent out of its plane, at least one strip engaging the bend of the discharge tube.

A known discharge lamp of the kind referred to is described, for example, in the British Patent Specification No. 1,545,384.

A disadvantage of this known discharge lamp is that the bend of the discharge tube is relatively cold in the operating condition. This means that the pressure in the discharge tube is lower than that which is required for obtaining a high luminous efficacy—expressed, for example, in lumen per Watt. This disadvantage is attributable to the fact that, although the metal member acts as a heat screen, this screen is not particularly effective due to the presence of apertures in the metal member.

The invention has for its object to provide a discharge lamp of the kind mentioned in the preamble, in which the operating condition of the lamp the bend of the discharge tube is kept at a sufficiently high temperature.

A gas and/or vapor discharge lamp according to the invention provided with a U-shaped discharge tube and an elongate outer envelope surrounding this tube, a bend of this discharge tube interconnecting the two limbs of the discharge tube is supported with respect to the outer envelope by means of a metal member of sheet material. The metal member has a flat annular part which is arranged mainly transverse to the longitudinal direction of the outer envelope and is provided with strips bent out of its plane, at least one strip engaged the bend of the discharge tube the metal member is composed of at least two parts, the first part being the annular part with the strips and a second part comprising a hood-shaped portion which surrounds the outer side of the bend of the discharge tube, while the parts of the member are arranged with respect to each other so that this member provides a substantially light-tight transverse separation between the outer envelope and the discharge tube.

An advantage of this lamp is that the metal member acts not only as a supporting member but also as an effective heat screen. The transverse separation constituted by the metal member in fact substantially prevents radiation energy originating from the discharge tube from leaking away in the vicinity of the bend of this discharge tube. The visible—as well as the generally also present infrared—radiation in this region is now collected by the metal member and utilized to increase the temperature of this bend.

During the assembly of the metal member, apertures which are formed by bending the strips of the first part out of their plane are covered by a further part of the metal member.

In a preferred embodiment of a discharge lamp according to the invention, the first part is provided with four strips, two of which engage the inner side of the bend of the discharge tube, while the remaining two strips co-operate with the convex side of the hood-shaped portion of the second part.

An advantage of this perferred embodiment is that a firm mechanical coupling is thus obtained in a simple manner.

It is conceivable that the metal member of a lamp according to the invention is composed of, for example, three parts, the third part being a flat plate which is provided with a hole and holds together the remaining parts of the metal member in co-operation with a few strips of the first part. The third part can then also cover any remaining aperture in the transverse separation.

In a next preferred embodiment of a lamp according to the invention, the metal member is composed of only two parts and the second part has, in addition to the hood-shaped portion, also a flat portion which is arranged transverse to the longitudinal direction of the outer envelope.

An advantage of this preferred embodiment is that the metal member is very simple. In this case, the second part closes practically entirely the apertures in the first part.

This second part may be twisted, for example, between the strips of the first part.

A lamp according to the invention may, for example, be a cadmium lamp.

In a preferred embodiment of a discharge lamp according to the invention, the lamp is a low-pressure sodium vapor discharge lamp.

An advantage of this preferred embodiment is that a light source with a very high luminous efficacy is now obtained.

An embodiment of the invention will now be described more fully with reference to the accompanying drawings. In the drawings.

Figure 1:
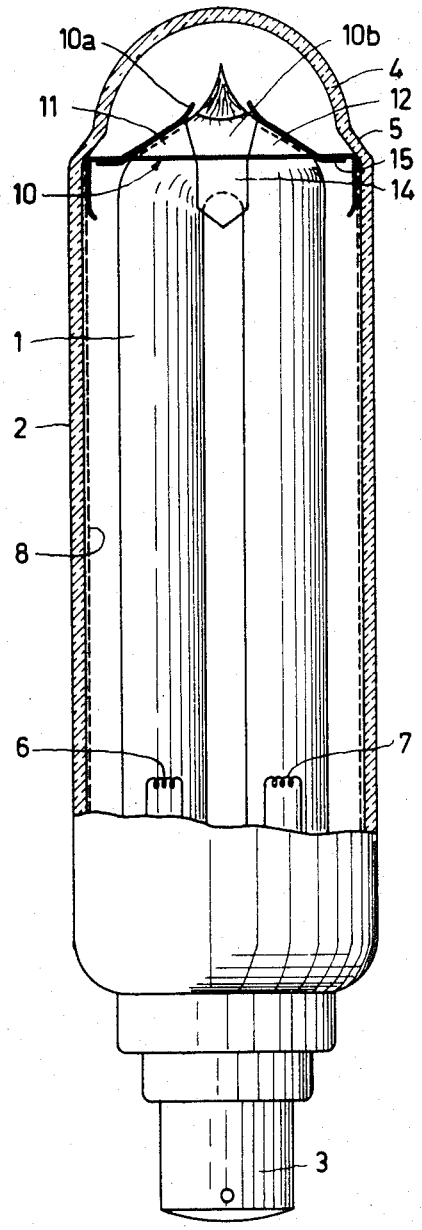
FIG. 1 is an elevation of a lamp according to the invention, the outer envelope being partly cut away.

The lamp shown in FIG. 1 is a low-pressure sodium vapor discharge lamp of approximately 18 Watt. Reference numeral 1 denotes a U-shaped discharge tube. Reference numeral 2 denotes an outer envelope surrounding this tube. The lamp is provided with a lamp cap 3. The side of the outer envelope 2 remote from the lamp cap 3 is provided with a hemispherical closing part 4. At the transition of the cylindrical part of the outer envelope to the hemispherical part 4, a local variation or profile 5 of annular form is present. The radius of the hemisphere in fact is somewhat smaller than the radius of the cylindrical part of the outer envelope 2. Reference numeral 6 denotes an electrode in an end of the U-shaped discharge tube 1. Reference numeral 7 denotes an electrode in the other end of the discharge tube 1. The two electrodes are connected to current-supply members which form part of the lamp cap 3. Reference numeral 10 denotes a metal plate-shaped member. This member is composed of two parts 10*a* and 10*b*.

The metal plate-shaped member 10 serves to support the bend of the discharge tube 1 with respect to the outer envelope 2. The member 10 acts at the same time as a heat screen. The metal member is provided with four strips 11 to 14 (see also FIGS. 2, 3 6 and 7). An annular part 15 of the metal member bears on the transition 5 of the cylindrical part to the hemispherical part of the outer envelope 2 of the lamp.

The lamp has a length of approximately 20 cm and a diameter of the outer envelope of approximately 5 cm. The diameter of each of the limbs of the discharge tube is approximately 1.5 cm. The discharge tube 1 contains an excess of sodium and a rare gas, in this case neon with an addition of 1% argon. The pressure of the rare gas is approximately 1000 Pascal. If desired, the discharge tube of the lamp described may further be provided with a few bumps by means of which the uniform distribution of the sodium is ensured. Reference numeral 8 denotes an infrared reflecting layer which is present on the inner side of the cylindrical part of the outer envelope 2. The layer 8 consists of indium oxide having a thickness of approximately 0.5 μm, this layer being transparent to visible light which is produced in the tube 1. The lamp described may be connected through a stabilization ballast (not shown), for example, an inductive impedance, to an alternating voltage of 220 Volt/50 Hz.

Figure 2:
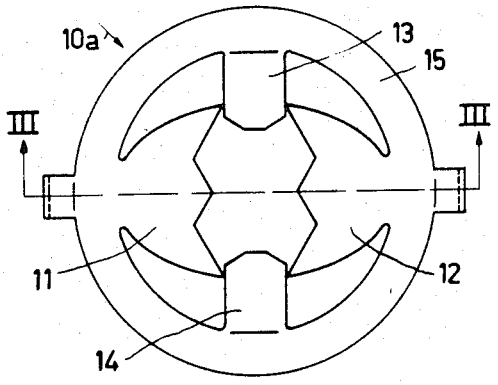
FIG. 2 is a plan view of a first part of an internal metal supporting member of the lamp of FIG. 1.

In FIG. 2, the first part 10*a* of the metal member 10 is further shown as viewed from the hemisphere 4 (see FIG. 1). This part consists of resilient steel having a thickness of approximately 0.3 mm. The strips 11 to 14 (see also FIG. 3) are obtained in that plate-shaped parts originally located in the plane of the annular member 15 are cut and bent out.

Figure 4:
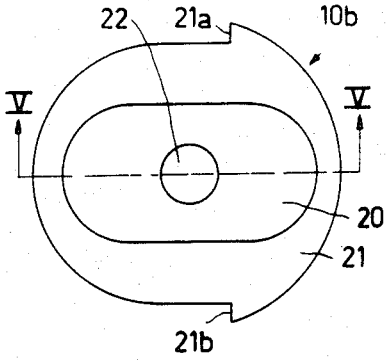
FIG. 4 is a plan view of a second part of the metal supporting member of the lamp of FIG. 1.
Figure 3:
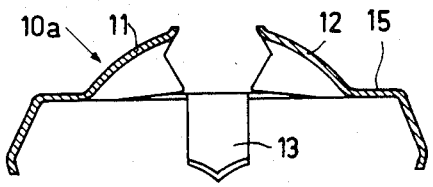
FIG. 3 is a sectional view of the first part of FIG. 2 taken on section III—III.

In FIG. 4 the second part 10*b* of the metal member 10 is shown. In this figure, reference numeral 20 denotes a hood-shaped portion (see also FIG. 5), the concave side of which—in the finished lamp (see FIG. 1)—surrounds the outer side of the bend of the discharge tube 1. Reference numeral 21 denotes a flat portion. This second portion also consists of resilient steel and also has a thickness of 0.3 mm. Reference numerals 21*a* and 21*b* denote cams of the portion 21. Reference numeral 22 denotes a hole in the hood-shaped portion 20. Through this hole a remaining part of the exhaust tube of the discharge tube will be passed (see FIG. 1).

Figure 5:
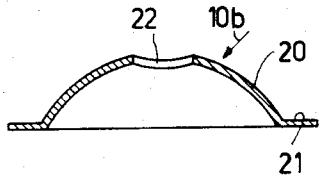
FIG. 5 is a cross-sectional view of the part of FIG. 4 taken on section V—V.

FIG. 5 is a cross-sectional view of the second part 10*b* taken on V—V.

Figure 6:
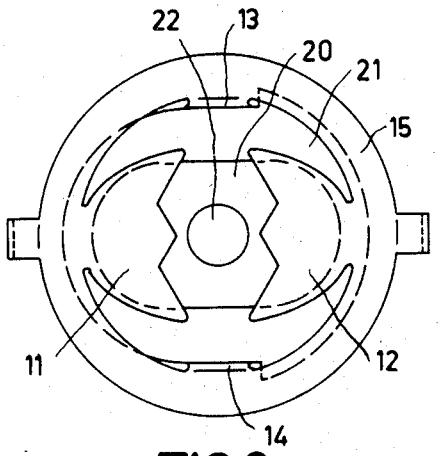
FIG. 6 is a plan view of the whole supporting member.

FIG. 6 illustrates that in this assembly of the two parts 10*a* and 10*b* of the metal member 10 the second portion (20, 21) is twisted between the strips 13 and 14 of the part 10*a* on the one hand and between the strips 11 and 12 of this part 10*a* on the other hand.

Figure 7:
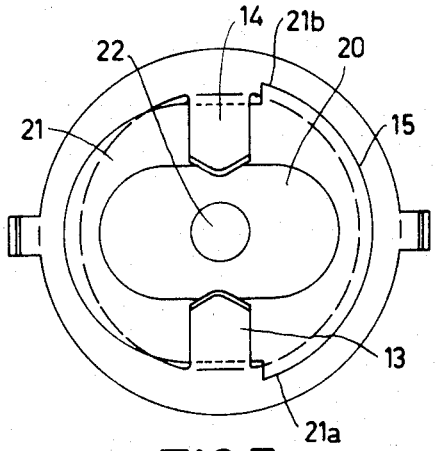
FIG. 7 is a bottom view of this supporting member.

FIG. 7 shows the cams 21*a* and 21*b* then engage the bases of the strips 13 and 14.

In the lamp of FIG. 1, the metal member 10 provides a substantially light-tight separation between the outer envelope 2 and the discharge tube 1 in the plane of the annular part 15. The mean reflection coefficient of the metal member is approximately 85% for the radiation emitted by the discharge tube.

By means of the metal member the discharge tube 1 is supported with respect to the outer envelope 2. However, at the same time the bend of the discharge tube is held at a comparatively high temperature of approximately 260° C. in the operating condition of the lamp. The luminous efficacy of the lamp described is approximately 180 lm/W.

Discharge lamps having a power different from that indicated may also be provided with a metal member 10, as mentioned above.

What is claimed is:

1. A gas and/or vapor discharge lamp provided with a U-shaped discharge tube and an elongate outer envelope surrounding said tube, a bend of said discharge tube interconnects the two limbs thereof, said discharge tube being supported with respect to the outer envelope by means of a metal member fabricated of sheet material, said metal member having a flat annular part which is disposed mainly transverse to the longitudinal direction of the outer envelope and is provided with four strips bent out of its plane, at least two strips engaging the bend of said discharge tube, said metal member being composed of at least two separate parts, the first part being the annular part with the strips and a second part comprising a hood-shaped portion which surrounds the outer side of said bend of said discharge tube, said parts of said member being dimensioned and configured with respect to each other to provide a substantially light-tight transverse separation between said outer envelope and said discharge tube.

2. A gas and/or vapor discharge lamp as claimed in claim 1, wherein the remaining two strips co-operate with the convex side of said hood-shaped portion of said second part.

3. A gas and/or vapor discharge lamp as claimed in claim 1 or 2, characterized in that the metal member is composed of only two parts and the second part has, in addition to the hood-shaped portion, also a flat portion which is arranged transverse to the longitudinal direction of the outer envelope.

4. A gas and/or vapor discharge lamp as claimed in claim 1 characterized in that the lamp is a low-pressure sodium vapor discharge lamp.

5. A gas and/or vapor discharge lamp as claimed in claim 2, characterized in that the lamp is a low-pressure sodium vapor discharge lamp.

6. A gas and/or vapor discharge lamp as claimed in claim 3, characterized in that the lamp is a low-pressure sodium vapor discharge lamp.

* * * * *